United States Patent [19]

Cromer et al.

[11] 4,276,456

[45] Jun. 30, 1981

[54] DOUBLE-FLOW PUFFER-TYPE COMPRESSED-GAS CIRCUIT-INTERRUPTER

[75] Inventors: Charles F. Cromer, Penn Township, Allegheny County; Kue H. Yoon, Pittsburgh, both of Pa.

[73] Assignee: Westinghouse Electric Corp., Pittsburgh, Pa.

[21] Appl. No.: 953,503

[22] Filed: Oct. 23, 1978

[51] Int. Cl.[3] ..... H01H 33/88

[52] U.S. Cl. ..... 200/148 A; 200/150 G

[58] Field of Search ..... 200/148 A, 148 E, 148 G, 200/149, 150 A, 150 G, 237–239, 289, 304, 305, 306

[56] References Cited

U.S. PATENT DOCUMENTS

| | | | |
|---|---|---|---|
| 3,786,215 | 1/1974 | Mauthe | 200/148 A |
| 3,814,883 | 6/1974 | Milianowicz | 200/150 G X |
| 3,946,183 | 3/1976 | Milianowicz | 200/148 A |
| 3,984,651 | 10/1976 | Lewis et al. | 200/149 A X |
| 3,987,262 | 10/1976 | Rostron | 200/148 A |
| 4,046,978 | 9/1977 | Badon | 200/148 A |
| 4,139,753 | 2/1979 | Cromer et al. | 200/148 A |
| 4,161,636 | 7/1979 | Maier | 200/148 A |

FOREIGN PATENT DOCUMENTS

| | | |
|---|---|---|
| 1217131 | 12/1970 | United Kingdom . |
| 1504739 | 3/1978 | United Kingdom . |
| 1547646 | 6/1979 | United Kingdom . |

*Primary Examiner*—James R. Scott
*Attorney, Agent, or Firm*—M. S. Yatsko

[57] ABSTRACT

An improved puffer-type, compressed-gas circuit-interrupter is provided having an improved double-flow operation, and improved cooling means for cooling the compressed gas prior to its ejection through the insulating movable nozzle and into the established arc. Additionally, the instant invention comprises the use of flexible movable arcing contact fingers with a surrounding cylindrical guide-valve sleeve to prevent premature leakage of compressed gas through the longitudinal finger slots provided in the movable arcing contact fingers during the opening operation. Such movable cylindrical guide-valve sleeve may be either insulating or metallic, as desired.

4 Claims, 11 Drawing Figures

1

CLOSED POSITION

CLOSED POSITION

OPEN PART-WAY

INITIAL ARC POSITION

CLOSED POSITION

OPEN PART-WAY

ARCING POSITION

DOUBLE-FLOW PUFFER-TYPE COMPRESSED-GAS CIRCUIT-INTERRUPTER

CROSS REFERENCE TO RELATED APPLICATIONS

Reference may be made to U.S. Pat. No. 4,139,751 by Joseph Rostron et al entitled "Improved Puffer-Type Compressed-Gas Circuit-Interrupter", and U.S. Pat. No. 4,123,636 by Cromer et al entitled "Improved Double-Flow Puffer-Type Circuit-Interrupter", both of said patents being assigned to the assignee of the instant patent application.

BACKGROUND OF THE INVENTION

The present invention is particularly related to puffer-type compressed-gas circuit-interrupters of the type in which only a single gas pressure is utilized within the interrupting container structure, and a difference of pressure for arc interruption is achieved by relative piston action, that is, relative movement of an operating cylinder to a cooperable piston structure.

As is well known by those skilled in the art, the relative motion between a movable operating cylinder assembly and a cooperable fixed piston achieves a desirable compression of gas therebetween within the intervening compression chamber, which compressed gas is utilized during arc interruption by generally forcing the compressed high-pressure gas through a movable nozzle structure to direct the high-pressure gas flow intimately into engagement with the established arc located within the movable nozzle structure to effect the arc's extinction.

The present invention relates to puffer-type circuit-interrupters of the type set forth in U.S. Pat. No. 3,551,623, issued Dec. 29, 1970 to Colcaser et al. This patent shows the relative motion of a movable piston within a relatively stationary operating cylinder, with electromagnetic field coils energizing a companion movable piston, which is electrically repelled toward the first-mentioned movable piston, the latter being attached to, and movable with, a contact-operating rod.

As is well known by those skilled in the art, there are many patents treating different piston structures, for example, U.S. Pat. No. 2,429,311, issued Oct. 21, 1947 to Gay; U.S. Pat. No. 3,786,215, issued Jan. 15, 1974 to Mauphe; and U.S. Pat. No. 3,987,262 issued Oct. 19, 1976 to Rostron.

An additional patent of interest in connection with piston structures is U.S. Pat. No. 3,331,935, issued July 18, 1967 to Milianowicz. Another piston patent, utilizing hydraulic action for effecting piston action, is U.S. Pat. No. 2,913,559, issued Nov. 17, 1959 to Cromer. An additional patent of interest is German Pat. No. 671,326 patented in Germany October, 1937.

All of the aforesaid patents indicate that piston structures of the prior art are well known, but many have deficiencies of complexity and of being rather slow in operation. In addition, back-pressure gas conditions may easily arise, which renders the interrupter, as a whole, relatively slow-acting in operation.

BRIEF SUMMARY OF THE INVENTION

An improved double-flow puffer-type compressed-gas circuit interrupter is provided having venting occurring through both the relatively stationary tubular arcing venting contact, and also through the movable tubular arcing venting contact. Preferably, the movable arcing contact is of a segmented slotted-finger construction being provided with an insulating, or metallic gas-leakage-preventing sleeve thereabout to prevent premature gas leakage through the finger slots of the movable arcing contact fingers.

Another aspect of the invention, for providing reduced mass of the moving parts, contemplates a finger-like stationary tubular venting arcing contact associated with the movable arcing contact, the latter, in this embodiment of the invention, comprising a solid tubular venting movable contact.

Still a further feature of the invention is directed to cooling segments, or protruding vanes associated with the stationary piston structure, over which the movable operating cylinder slides, thereby compressing gas therebetween.

DESCRIPTION OF THE PREFERRED EMBODIMENTS

Figure 1:
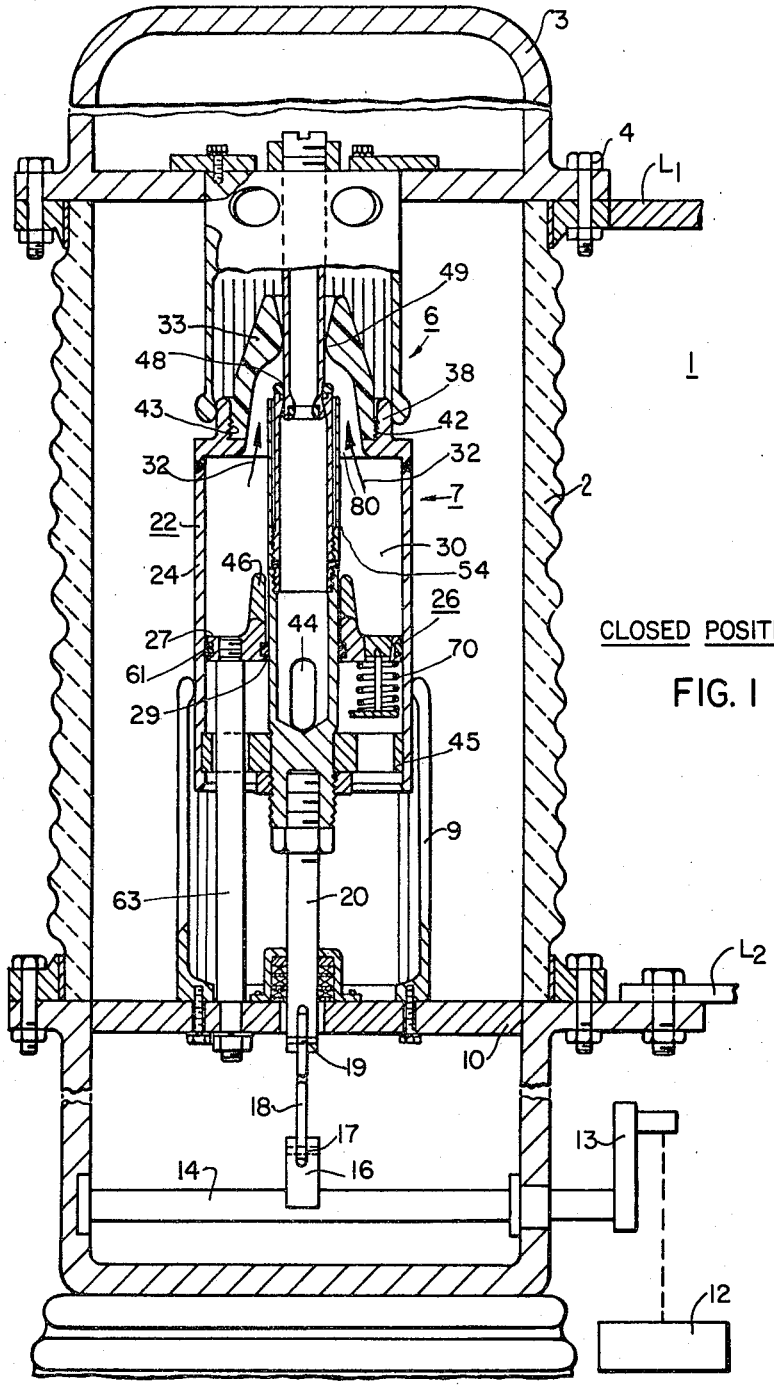
FIG. 1 is a vertical sectional view taken through one embodiment of the present invention illustrating a double-flow type of puffer circuit-interrupter, with the separable contacts being illustrated in the closed-circuit position.

Referring to the drawings, and more particularly to FIGS. 1-5 thereof, it will be observed that there is provided a puffer-type compressed-gas circuit-interrupter 1 having an upstanding insulating casing structure 2, which is provided at its upper end with a metallic dome-shaped conducting cap portion 3, the latter supporting, by means of a bolt 4, a line-terminal connection $L_1$.

Figure 2:
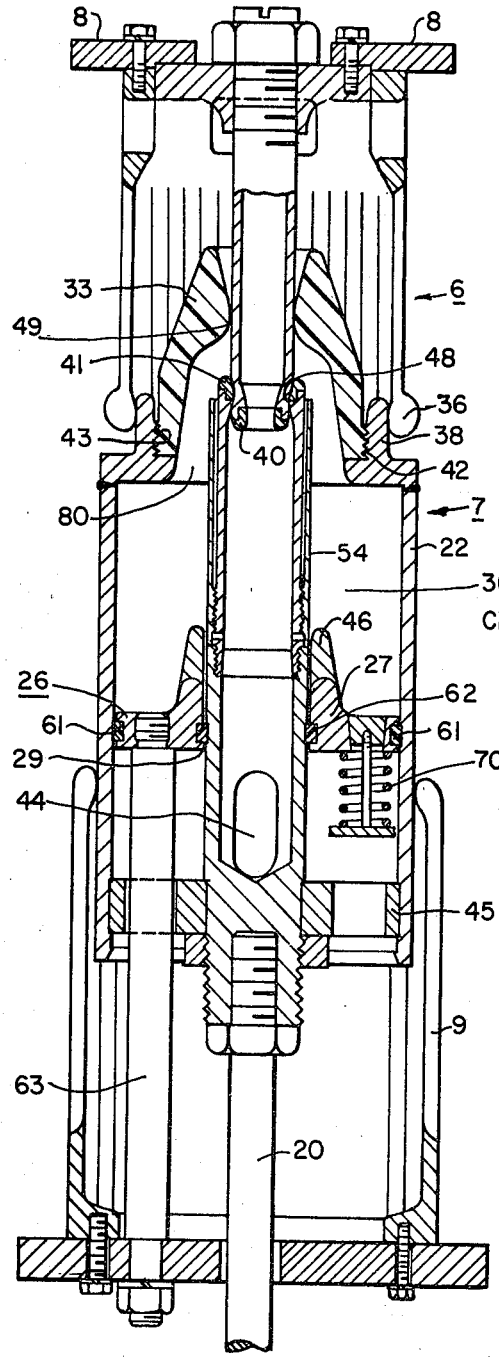
FIG. 2 illustrates, to an enlarged scale, the circuit-interrupting unit of FIG. 1, also being shown in the closed-circuit position.

Extending downwardly interiorly of the conducting dome-shaped casting 3 to within the casing 2 is a relatively stationary contact structure, designated by the reference numeral 6, and cooperable in the closed-circuit position with a movable contact structure 7, as illustrated more clearly in FIG. 2 of the drawings. The movable contact structure 7 is electrically connected, by means of conducting fingers 9 to a generally-horizontally-extending conducting support plate 10, which provides a second line terminal $L_2$ externally of the casing 2, as shown more clearly in FIG. 1.

A suitable operating mechanism 12 of conventional form effects rotation of an externally-provided crank-arm 13, the latter effecting opening and closing rotative motions of an internally-disposed operating shaft 14. The operating shaft 14, in turn, is fixedly connected to an internally-disposed rotative crank-arm 16, which is pivotally connected, as at 17, to a floating link 18, the latter being pivotally connected, as at 19, to the lower end of a linearly-movable contact-operating rod 20.

It will be noted that the upper end of the contact-operating rod 20 terminates in the movable contact 7 itself, which, as mentioned heretofore, makes contacting closed-circuit engagement with the stationary contact structure 6 in the closed-circuit position of the interrupting device 1.

A movable operating cylinder assembly 22 is provided having a large-diameter, downwardly-extending movable sleeve portion 24, which slidably moves over a relatively fixed piston structure 26.

The piston structure 26 is comprised of the piston 27 and the metallic guide vanes, or metallic protrusions 46. The piston 27 is contoured to nest within the confines of the moving cylinder assembly 22, and is electrically insulated from the cylinder assembly 22 by the insulating rings 61. The piston 27 has a central bore 29 therethrough, with the movable contact structure 7 extending through the bore 29. The piston 27 is supported within the casing 2 by a plurality of supporting legs 63 which are secured to the support plate 10.

Disposed about the movable contact structure 7 as it extends through the bore 27 are a plurality of metallic guide vanes 46. These guide vanes 46 are made up of relatively thin fins which act as "coolers" to cool the gas which is being utilized to extinguish the arc 34. The vanes 46 become particularly effective whenever they are disposed at the reduced flow section 80 of the moving cylinder assembly 22, which occurs towards the end of the opening operation.

The stationary contact structure 6 comprises the stationary main contact 36, a stationary arcing contact 40, and the support plate 8. Both the stationary main contact 36 and the stationary arcing contact 40 are secured to the electrically conducting support plate 8, which in turn, is secured to the cap 3 to conduct current to the line $L_1$.

Referring now more particularly to FIG. 2, the movable contact structure 7 includes the main movable contact 38, the movable arcing finger contact assembly 41, and the nozzle 33, with the arcing finger contact assembly 41 projecting beyond the main contacts 38. The main contact 38 is either secured to, or formed integrally with, the upper surface of the operating cylinder 22. The main contact 38 has a plurality of threads 42 therein which engage similar threads 43 on the nozzle 33 such that the main contact 38 also functions to secure the nozzle 33 to the operating cylinder 22.

The arcing finger contact assembly 41 is secured to the operating rod 20, which provides reciprocating motion thereto. Also secured to the arcing finger contact assembly 41, by means such as the plate 45, is the sleeve portion 24 of the operating cylinder 22. By so being connected, the arcing finger contact assembly 41, the operating cylinder 22, the main movable contact 38, and the nozzle 33 all move together.

Figure 6:
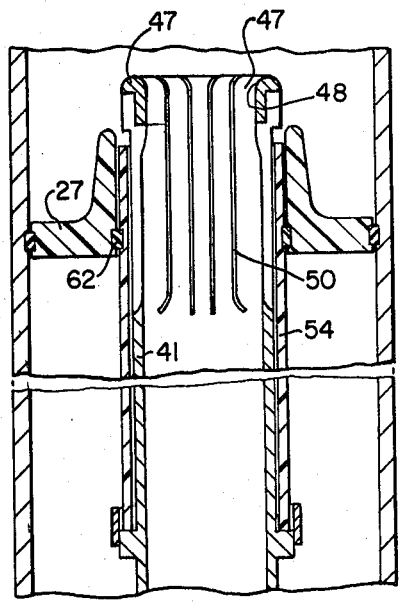
FIG. 6 is a detailed view illustrating the slotted moving arcing contact fingers, and the gas-leakage-preventing sleeve thereabout, the sleeve being illustrated as of insulating material.
Figure 7:
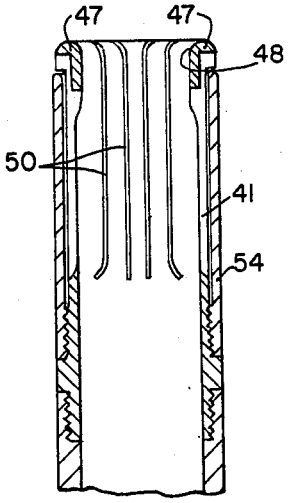
FIGS. 7 and 8 are detailed views illustrating modified movable segmented arcing contact assemblies with the gas-leakage preventing sleeve being of aluminum or metallic construction.
Figure 8:
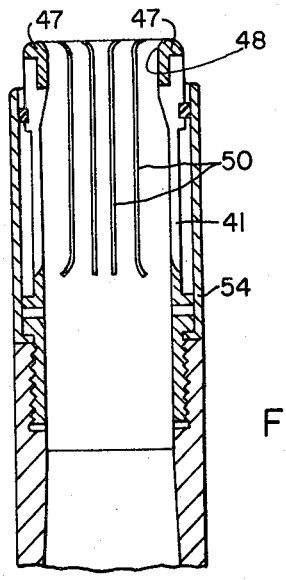

The arcing finger contact assembly 41 is formed by providing a plurality of slots 50 in a tubular member to provide resiliency to the individual arcing finger contacts 47. (see FIG. 6) The individual arcing finger contacts 47 form an opening 48 (see FIG. 4) therebetween in which is disposed the stationary arcing contact 40 when the interrupter is in the closed position, and through which the insulating gas, which may be sulphur hexafluoride, flows during arc exctinction. Surrounding the arcing finger contact assembly 41 is the sleeve shield 54, illustrated in FIG. 6 as being of an insulating material. The sleeve shield 54 functions to prevent the excessive loss of gas through the several segmenting slots 50 during the opening operation. The sleeve shield 54 can also be of a metallic, electrically-conducting material, as shown in FIGS. 7 and 8, and can be secured to the arcing finger contact assembly 41 by any of the means shown in FIGS. 6, 7 or 8, although a threaded connection (FIG. 7) is preferred so that replacement can be accomplished without the replacement of the entire unit. The sleeve shield 54, if metallic, need not be of the same material as the arcing finger contact assembly 41, but should be insulated from the piston 27 by means such as the insulating ring 62 to prevent welding.

Figure 5:
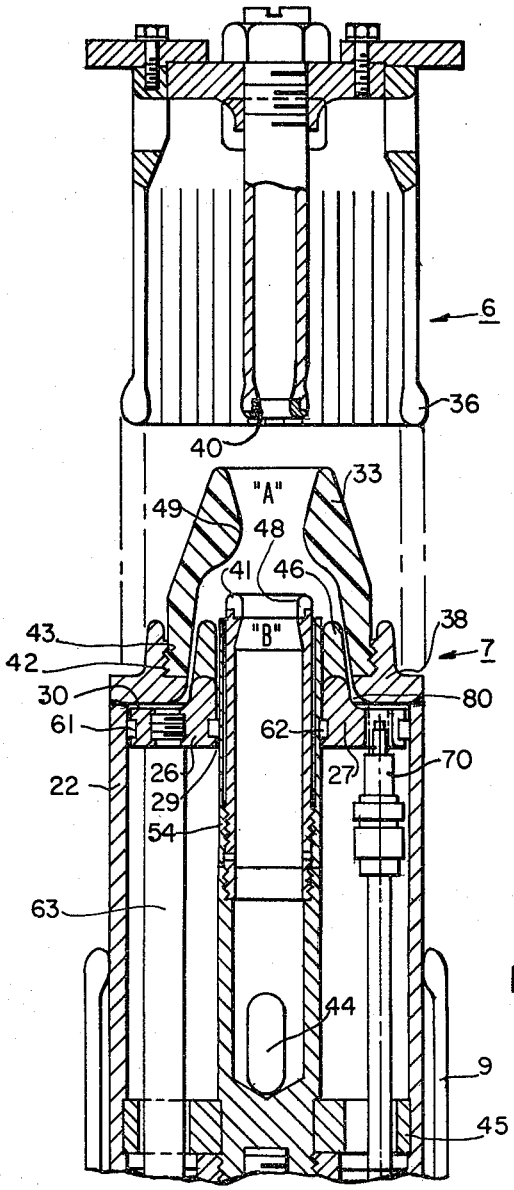
FIG. 5 is a view similar to that of FIG. 2 showing the position of the several parts when the circuit-interrupting unit is in the fully-open circuit position.

Referring now to FIG. 5, it will be observed that the dimension "A" through the constricted portion 49 of the insulating nozzle 33, and the dimension "B", the opening 48 in the arcing finger contact assembly 41, are correlated, as shown, in a desirable manner. The dimension "A" is approximately the same size as dimension "B". The minimum distance between the minimum diameter 49 of the nozzle 33 and the arcing finger contact assembly 41 allows only a minimum build-up of arc products in that area, resulting in a more rapid clearing and recovery of dielectric strength.

Figure 3:
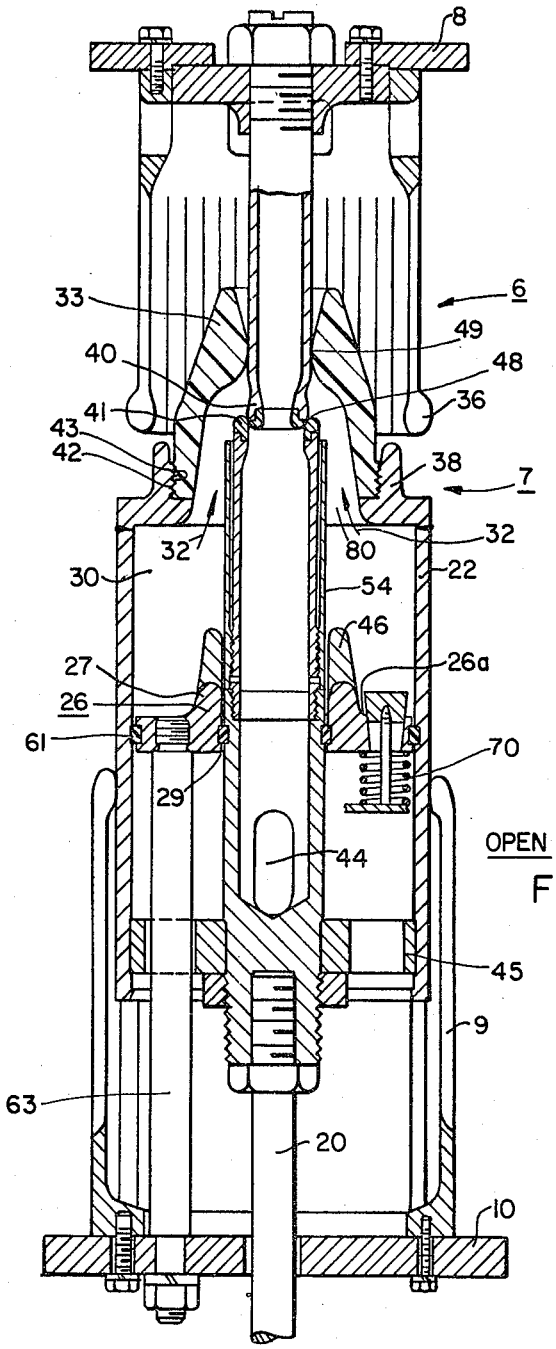
FIG. 3 is a view similar to that of FIG. 2, but illustrating the position of the several parts during the initial portion of the opening operation, wherein the main contacts have separated, but the separable arcing contacts are still in contacting engagement.
Figure 4:
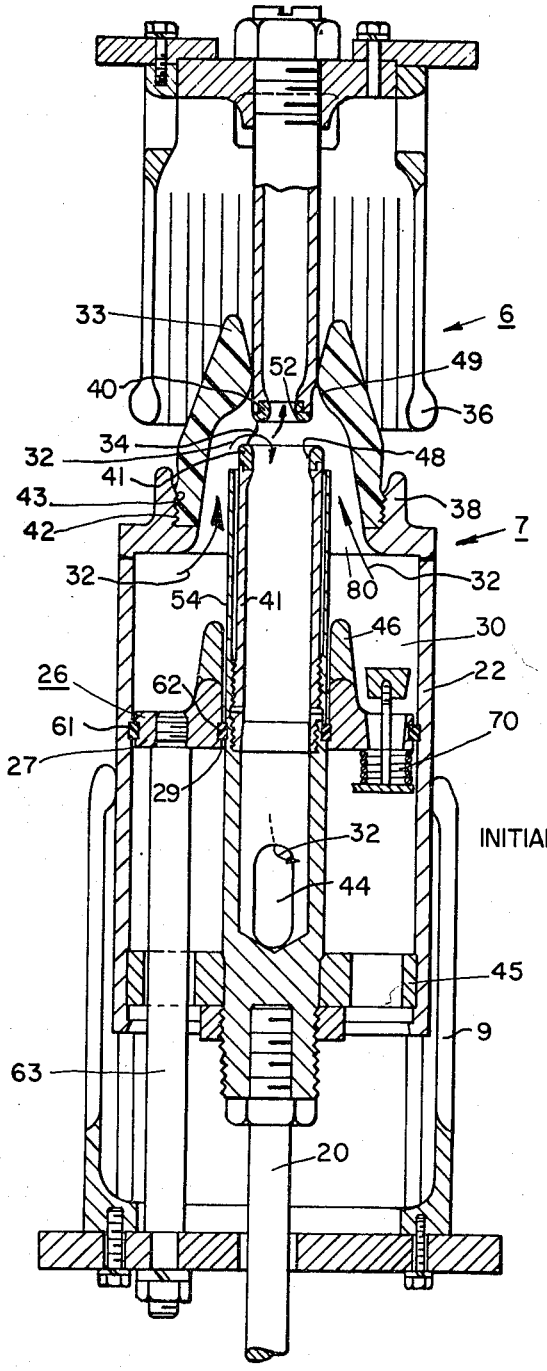
FIG. 4 is a view similar to that of FIG. 2 illustrating the disposition of the several contact parts during a further stage of the opening operation of the circuit-interrupter wherein arcing ensues.

Referring now sequentially to FIGS. 3, 4, and 5, the opening operation of the interrupter 1 is described below. As the operating rod 20 moves the operating cylinder 22 and the arcing finger contact assembly 41 downward, as shown in the drawing, the movable main contact 38 separates from the stationary main contact 36, so that all current flow is through the arcing contacts 40, 41. The cylinder 22 has moved over the piston 27 and has begun to compress the gas in the region 30 therebetween.

Further downward movement causes a separation between the stationary arcing contact 40 and the movable arcing contact assembly 41, with an arc 34 being drawn therebetween. The cylinder 22 has moved further past the piston 27, and the gas in the region 30 has compressed and is flowing 32 through the nozzle 33 to extinguish the arc 34. It is to be noted that the blast of gas, once past the arc 34, flows in two opposite directions: through the opening 52 of the hollow stationary arcing contact; and through the opening 48 of the movable arcing finger contact assembly 41, where it can exhaust out of the lateral apertures 44 which are provided therein beneath the piston 27. Also occurring during this interval is the cooling of the compressed gas by the guide vanes 46 which are secured to the upper surface 26*a* of the piston 27.

In FIG. 5, the movable main and arcing contacts 38, 41 are fully separated from the stationary contacts 36, 40, and the arc has been extinguished. The operating cylinder 22 has now moved adjacent to the piston 27. The interrupter is now ready to move into the closed position, which occurs in a manner the reverse of that heretofore described. During closing, check valves 70 are provided to allow filling of the region 30 between the piston 27 and the cylinder 22.

Figure 9:
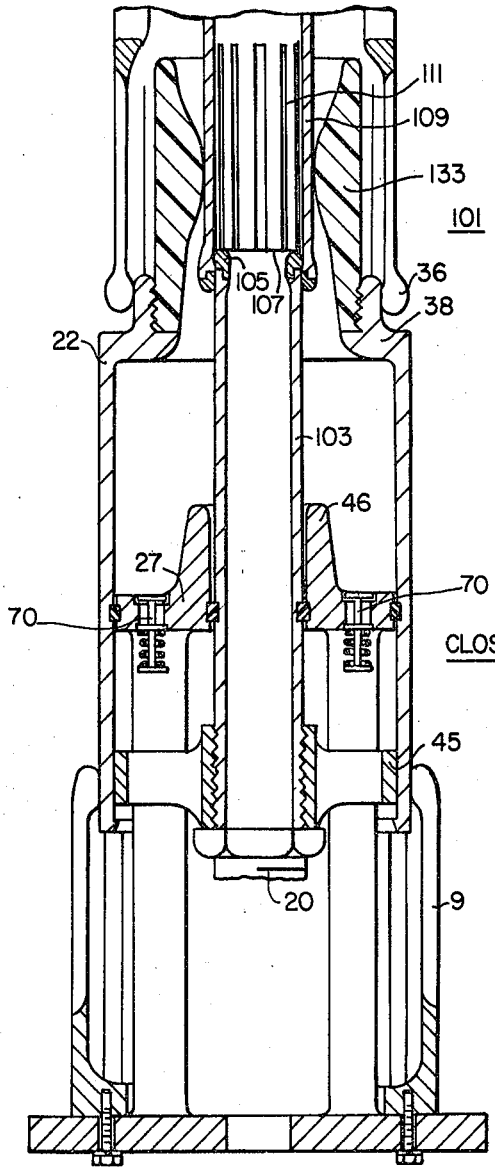
FIG. 9 illustrates a modification of the invention illustrated in FIG. 2. in which the segmented arcing contact-finger construction is associated with the stationary contact portion of the interrupting unit, with the movable arcing contact being of solid tubular construction, the view illustrating the contact parts in the closed-circuit position.
Figure 10:
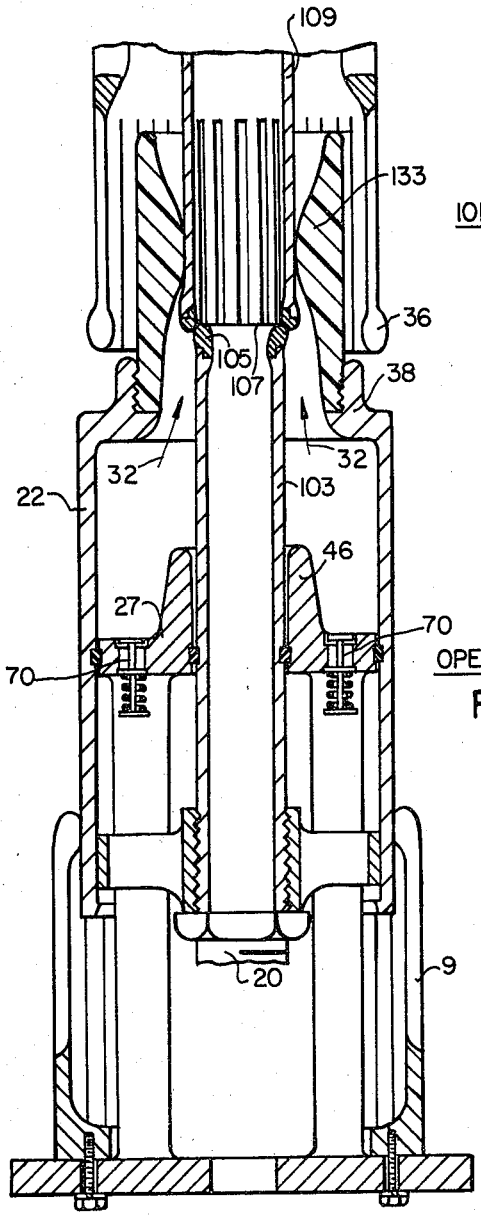
FIG. 10 is a view similar to that of FIG. 7, but illustrating the disposition of the several contact parts during the initial portion of the opening operation, with the main contacts separated, and the arcing contacts still remaining in engagement.
Figure 11:
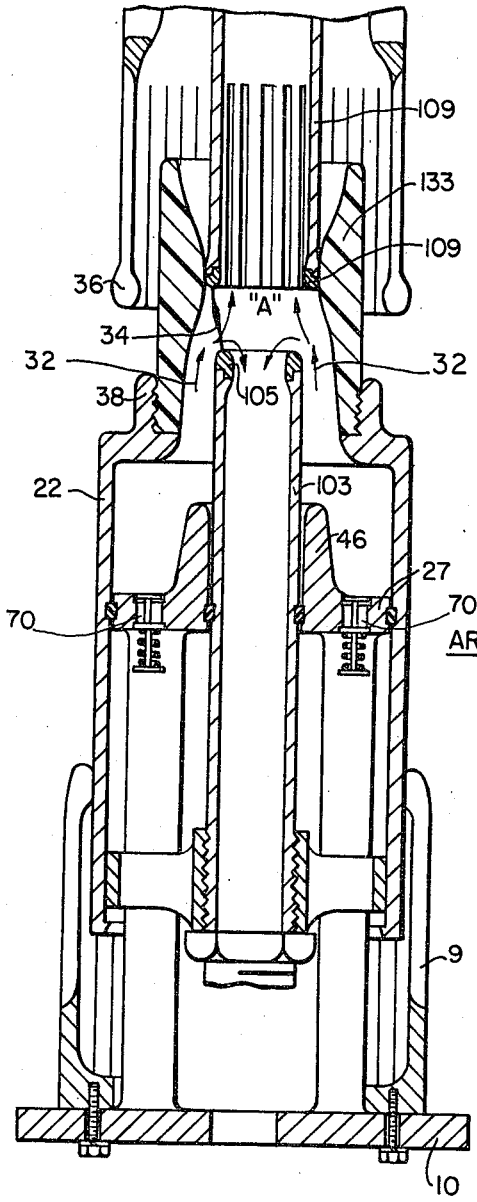
FIG. 11 illustrates a sectional view, similar to that of FIGS. 9 and 10, but showing the arcing condition of the circuit-interrupter.

FIGS. 9, 10 and 11 illustrate a circuit interrupter 101 similar in most respects to that illustrated in FIGS. 1–8. The major difference in the modification is that the movable arcing contact 103 in FIGS. 9–11 is a solid, tubular member having an arc resistant material 105 at the upper end 107 thereof instead of being the segmented movable arcing finger contact assembly 41 of FIGS. 1–8. In the modification, the stationary arcing contact 109 is formed segmented by slots 111 to provide flexibility, and the stationary arcing contact 109 now functions similarly to provide contact with the solid movable arcing contact 103. This modification reduces the mass of the parts moving in the interrupter 101.

To be noted in FIGS. 9–11, the sleeve shield 54 of FIGS. 1–8 is no longer needed, as the slots 111 do not, in their location, allow the escape of gas which is being pressurized between the cylinder 22 and the piston 27 until such time as the gas has flowed past the arc 34. Also, in this modification, the dimension "A" of the nozzle 133, and the nozzle 133 itself, must be made larger to accommodate the greater diameter of the stationary arcing contact 109. The operation of the interrupter 101 otherwise operates as heretofore described.

Thus, what has been described is a new and improved double flow puffer-type circuit interrupter which utilizes a segmented arcing contact to provide flexibility in contact engagement and a plurality of cooling vanes to cool the compressed gas to increase its effectiveness in quenching the arc.

We claim as our invention:

1. A puffer-type gas-insulated circuit interrupter comprising:

a stationary contact structure including stationary main and arcing contacts;

a cooperable movable contact structure including a movable main contact, a movable arcing finger contact assembly including a cluster of circumferentially-disposed arcing contact fingers having longitudinal slots between the finger portions thereof, and a tubular sleeve shield disposed in encompassing relationship with said movable cluster of arcing contact fingers to prevent premature leakage of compressed gas through said longitudinal slots during the opening operation;

means defining a relatively-stationary piston structure having a plurality of metallic cooling vanes spaced apart and protruding in the general direction of said stationary contact structure;

a movable operating cylinder movable over said piston structure and carrying said movable contact structure;

a movable hollow insulating nozzle movable with said movable operating cylinder, said hollow nozzle encompassing said stationary arcing contacts and said movable arcing contact fingers when in the closed position, a gas compressed between said operating cylinder and said piston structure during an opening operation and flowing through said hollow nozzle into the arc drawn between said stationary and movable contact structures during the opening operation to effect the extinction thereof, said compressed gas flowing over said spaced cooling metallic vanes to be cooled thereby prior to the gas injection into the arc; and an outer casing structure enclosing said stationary and movable contact structures, said piston structure, said operating cylinder, said nozzle and said gas.

2. The interrupter according to claim 1, wherein the sleeve shield is of metallic material.

3. The interrupter according to claim 1, wherein the sleeve shield is of insulating material.

4. A puffer-type gas-insulated circuit interrupter comprising:

a movable contact structure including movable main and arcing contacts;

a cooperable stationary contact structure including a stationary main contact and a stationary arcing contact comprising a cluster of circumferentially-disposed contact fingers having longitudinal slots between the finger portions thereof;

means defining a relatively-stationary piston structure having a plurality of metallic cooling vanes spaced apart and protruding in the general direction of said stationary contact structure;

a movable operating cylinder movable over said piston structure and carrying said movable contact structure;

a movable hollow insulating nozzle movable with said movable contact structure and said movable operating cylinder, said hollow nozzle encompassing said movable and stationary arcing contacts when in the closed position;

a gas compressed between said operating cylinder and said piston structure during an opening operation and flowing through said hollow nozzle into the arc drawn between said stationary and movable arcing contacts during the opening operation to effect the extinction thereof, said compressed gas flowing over said spaced cooling metallic vanes to be cooled thereby prior to the gas injection into the arc; and an outer casing structure enclosing said stationary and movable contact structures, said piston structure, said operating cylinder, said nozzle and said gas.

* * * * *